US011143371B2

(12) United States Patent
Bembridge et al.

(10) Patent No.: US 11,143,371 B2
(45) Date of Patent: Oct. 12, 2021

(54) MAST, LIGHTING DEVICE, AND STREET LIGHT POLE

(71) Applicant: SIGNIFY HOLDING B.V., Eindhoven (NL)

(72) Inventors: Mathew Lee Bembridge, Eindhoven (NL); Gun-Seok Oh, Eindhoven (NL); Romain Thiery, Eindhoven (NL); Yong Ju Jeong, Eindhoven (NL); Winand Hendrik Anna Maria Friederichs, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 207 days.

(21) Appl. No.: 16/471,582

(22) PCT Filed: Dec. 13, 2017

(86) PCT No.: PCT/EP2017/082560
§ 371 (c)(1),
(2) Date: Jun. 20, 2019

(87) PCT Pub. No.: WO2018/114510
PCT Pub. Date: Jun. 28, 2018

(65) Prior Publication Data

US 2021/0131629 A1 May 6, 2021

(30) Foreign Application Priority Data

Dec. 22, 2016 (EP) ..... 16206362
Jan. 26, 2017 (EP) ..... 17153244

(51) Int. Cl.
*F21S 8/08* (2006.01)
*E04H 12/00* (2006.01)
(Continued)

(52) U.S. Cl.
CPC ..... *F21S 8/088* (2013.01); *E04H 12/00* (2013.01); *F21V 21/116* (2013.01);
(Continued)

(58) Field of Classification Search
CPC ..... F21S 8/088; E04H 12/00; F21V 21/116; F21W 2131/103; H01Q 1/1228
See application file for complete search history.

(56) References Cited

U.S. PATENT DOCUMENTS 5,880,701 A * 3/1999 Bhame ..... H01Q 1/1207 343/890
6,222,503 B1 * 4/2001 Gietema ..... H01Q 1/1207 343/700 MS (Continued)

FOREIGN PATENT DOCUMENTS

EP 2389710 B1 8/2012
EP 2796774 A1 10/2014
GB 2464288 A1 4/2010

*Primary Examiner* — Alexander K Garlen

(57) ABSTRACT

The invention provides a mast comprising a modular, hollow tubular body having cylindrical, outer wall segments with an outer surface and enclosing an axially extending cavity, said tubular body comprising in its cavity a first mast segment arranged in between a base segment and a second mast segment and releasably connected thereto. Each of the base, first and second mast segment has an internal structure for bearing the weight of the mast, the internal structure of the first mast segment comprises in the cavity an axially extending inner cylinder connected via radially extending ribs to outer cylinder portions at a first respectively a second end of the inner cylinder and said ribs axially extending from said first end to said second end. Said inner structure being surrounded by a removably mounted, outer wall segment. The inner cylinder by a core wall of the inner cylinder encloses an axially extending core cavity for enabling cabling to pass through from the cavity in the base segment
(Continued)

to the cavity in the second mast segment. In mounted position the first part is connected with the first end of its core wall directly to the base part and with a second end of its core wall to the second mast segment.

14 Claims, 7 Drawing Sheets

(51) Int. Cl.
*F21V 21/116* (2006.01)
*F21W 131/103* (2006.01)
*H01Q 1/12* (2006.01)

(52) U.S. Cl.
CPC ..... *F21W 2131/103* (2013.01); *H01Q 1/1228* (2013.01); *H01Q 1/1242* (2013.01)

(56) References Cited

U.S. PATENT DOCUMENTS

| | | | | |
|---|---|---|---|---|
| 8,593,370 | B2 * | 11/2013 | Caldwell | H01Q 1/1242 343/890 |
| 2005/0007295 | A1 * | 1/2005 | Janoschka | H01Q 1/1242 343/890 |
| 2005/0030250 | A1 * | 2/2005 | Gotti | H01Q 1/246 343/878 |
| 2011/0156984 | A1 * | 6/2011 | Caldwell | H01Q 1/1207 343/890 |
| 2014/0240193 | A1 | 8/2014 | Caldwell et al. | |
| 2015/0013261 | A1 * | 1/2015 | Kolokotronis | B23P 15/00 52/651.07 |
| 2016/0290619 | A1 * | 10/2016 | Galloppa | F21S 8/083 |

* cited by examiner

MAST, LIGHTING DEVICE, AND STREET LIGHT POLE

CROSS-REFERENCE TO PRIOR APPLICATIONS

This application is the U.S. National Phase application under 35 U.S.C. § 371 of International Application No. PCT/EP2017/082560, filed on Dec. 13, 2017, which claims the benefit of European Patent Applications Nos. 17153244.3, filed on Jan. 26, 2017, and 16206362.2, filed Dec. 22, 2016. These applications are hereby incorporated by reference herein.

BACKGROUND OF THE INVENTION

The invention relates to a mast having a longitudinal axis and comprising a modular, hollow tubular body having cylindrical, outer wall segments with an outer surface and enclosing an axially extending cavity, said tubular body comprising a first mast segment arranged in between a base segment and a second mast segment and releasably connected thereto. The invention further relates to a street pole, and to a street light pole (a lighting device also sometimes referred to as street luminaire).

FIELD OF THE INVENTION

Such a mast is known from US20140240193 as an antenna structure. In the known antenna structure the antenna is the first mast segment, which is built into the mast in an obtrusive manner. Though the antenna is mounted inside the cavity of the first mast segment so that the antenna itself is not visible to an observer, the first mast segment accommodating the antenna is clearly distinguishable. The known antenna structure comprises a continuous inner cylinder onto which elements can be mounted and covered by an exchangeable outer wall segment. The known antenna structure has the disadvantages of a relatively obtrusive presence of said first mast segment due to the visibility of bolts extending through the outer wall segments. Said bolts are used for fixation (and optionally dismounting) of the mounted (first) segment and the outer wall segment onto the inner cylinder. Furthermore the known antenna structure has the disadvantage of a relatively high risk of a malfunctioning antenna or electronic equipment mounted onto the continuous inner cylinder.

SUMMARY OF THE INVENTION

In view of the above-mentioned and other drawbacks of the prior art devices, a general object of the invention is to provide an improved mast. Thereto the mast of the type as described in the opening paragraph comprises a modular, hollow tubular body having a circumferential, outer wall with an outer surface and enclosing an axially extending cavity, said tubular body comprising in its cavity a first mast segment arranged in between a base segment and a second mast segment and releasably connected thereto, each of the base, first and second mast segment has a bearing structure bearing the weight of the mast, at least the first mast segment comprises as an internal bearing structure in the cavity an axially extending inner cylinder connected via radially extending ribs to outer cylinder portions at a first respectively a second end of the inner cylinder and said ribs axially extending from said first end to said second end, said inner structure being surrounded by an outer wall segment axially extending from said first end to said second end, the inner cylinder by a core wall of the inner cylinder encloses an axially extending core cavity for enabling cabling to pass through from the cavity in the base segment to the cavity in the second mast segment, in mounted position the first mast segment is connected with the first end of its core wall directly to the base part and with a second end of its core wall directly to the second mast segment wherein the inner cylinder, the outer cylinder and the outer wall segment of the first mast segment enclose at least one axially extending compartment, and wherein the first mast segment has at the first and second end respectively a first and second closing feature each comprising as a sealing portion of a first and second gasket, which, in mounted position, are pressed between respectively the outer wall segment and a respective extension shaft and the core wall and a respective extension shaft to seal said compartment.

Releasably or removably mounted, fixed or connected in this respect means that a part can be removed and remounted without tools or by using simple tooling without the need for breakage or fracture of the connection between connected parts, i.e. typically not referring to connected parts made in one piece.

The bearing structure of the segments, and in particular the internal bearing structure of the first mast segment renders the segments to be a constructive part, i.e. each part as such is strong and rigid enough to be able to adequately bear that part of the mast it is carrying. Due to the feature that the first mast segment is releasably connected to the base segment and to the second mast segment by its inner cylinder, bolts to releasably connect the first mast segment to the base segment and the second mast segment can be completely encompassed or contained within the cavity and hence are no longer visible at the outside of the mast. Because in the mast of the invention, and contrary to the known antenna structure, at least at the location of the connection between the segments, the robustness of the mounted structure comes from the inner and outer cylinder and not (necessarily) from the outer wall, it is alternatively possible to use blind bolts that are sunken or flush with the outer surface of the outer wall. This renders the mast of the invention to have the advantage that said first mast segment is unobtrusively mounted in the mast and thus the mast looks more attractive, is less vulnerable and is less attractive to vandalism. The mast may be constructed in the shape of a common mast-like object such as a flagpole, a street lamp, a sign post, a utility pole, a church steeple, a vertical column in a building, or a horizontal rail in a building. The first mast segment may be considered as the top portion of the mast, hence then the second mast segment may be a simple closing lid for closing the cavity and/or the core cavity, and the antenna may include a plurality of antenna elements, for example in a vertically stacked array configuration. Optionally, the outer wall segment that axially extends from said first end to said second end may be removably mounted to adjust the outer appearance of the mast (segment), for example to change its color.

The mast has the feature that the first mast segment has at the first and second end respectively a first and second closing feature each comprising as a sealing portion of a first and second gasket, which, in mounted position, are pressed between respectively the outer wall segment and a respective extension shaft and the core wall and a respective extension shaft. In this way it is enabled to seal (parts) of the internal cavity against the ambient, i.e. against ingress moisture and of dust, the sealing quality can fulfill ingress protection of at least IP54 level, for example IP55 or IP66 requirements. For example in compartments that are formed by the ribs, the core wall, the outer wall and the outer cylinders in the internal cavity electronic equipment, sensitive to moisture and dust, can safely be housed. Thus early malfunctioning of the antenna and/or other electronic equipment accommodated within the mast, is counteracted.

The mast might have the feature that both the first end and the second end of the inner cylinder have an extension shaft as an interface part extended beyond the outer wall, in mounted position a respective extension shaft being inserted into an associated cavity of the base segment and of the second mast segment, preferably said extension shaft is in a clamping fit or snapping fit connection with the base segment respectively with the second mast segment. This enables an easy mounting and dismounting of the first mast segment without the need of tools. The inner cylinder and shafts (interface parts) have a diameter in a range of 0.3 to 0.7 times the diameter of the outer cylinder to render the internal structure to have a desired strength and rigidity on the one hand, and on the other hand to provide enough space for the accommodation of the antennas. Thus it is enabled to provide an RF functionality essentially within the contour of an existing mast structure, for example essentially without an increase in diameter of an existing mast structure. The mast might have the feature that the extension shaft has a minimal length of at least twice, preferably at least three times, a maximum diameter of the shaft, thus increasing the robustness and rigidity of the connection of the first mast segment to the base segment and to the second mast segment. Alternatively, the shaft has a length that is at least two times a maximal diameter of said first mast segment, thus even more increasing the robustness and rigidity of the connection of the first mast segment to the base segment and to the second mast segment.

The mast might have the feature that the base segment, the first mast segment and the second mast segment have mutually matching shapes and diameters in cross-section, preferably in mounted position the outer surface of the outer wall of the base segment, the first mast segment and the second mast segment are flush. This renders the mast of the invention to have the advantage that said first mast segment is even more unobtrusively mounted in the mast and thus looking even more attractive and being even less vulnerable and less attractive to vandalism.

The mast might have the feature that at least one of the inner cylinder and outer cylinder comprises an end cap as a sealing portion having a feature, for example a groove, matching to the shape of a sealing gasket. This is a convenient, relatively cheap and reliable way to attain the desired sealing. Furthermore, said end cap can be provided with specific features not easily being providable onto the outer cylinder parts, for example sealed feedthroughs for cabling for electric equipment accommodated in the compartments.

The mast might have the feature that the internal structure of the first mast segment is an integral, extruded part. This is a convenient and relatively fast and cheap manufacturing method to manufacture said internal structure.

The mast might have the feature that the inner cylinder, the outer cylinder and the outer wall segment of the first mast segment enclose an axially extending compartment, wherein the first mast segment comprises a plurality of compartments defined by the internal bearing structure and separated by the ribs. The ribs not only contribute to the strength and rigidity of the internal structure but simultaneously shield the optionally provided electronic equipment in the various compartments from each other, if so desired.

The mast might have the feature that the compartment accommodates both an electronic component and an associated antenna element facing towards the outer wall segment, said outer wall segment being at least partly made of RF transparent material. In one aspect, the present invention is a mast-like object concealing an antenna and associated antenna components. The mast-like object comprises an elongate tube from a dielectric material, and with the antenna and the antenna components inside a replaceable first mast segment having a Radio-Frequency (=RF) transparent outer wall and being insertable between the base segment and the second mast segment. In the case the mast is a lighting device, the mast may comprise cabling for a light source, said cabling being passed through from the cavity in base segment to the cavity in the second mast through the core cavity of the first mast segment. At the location of the first mast segment comprising the antenna, the cabling for the light source and the antenna and associated electronic components therefore are mutually separated as they are located in respectively the core cavity and the compartment by dielectric material of the inner cylinder. Hence, the safety of the lighting device is enhanced and the risk on EMC distortion by the antenna on the power net and vice versa, is reduced.

The mast might have the feature that each compartment comprises a respective radiating element that can act as a part of an antenna. The risk on mutual distortion of the antennas is reduced hereby thus increasing the reliability of lifetime expectance of the mast.

The mast might have the feature that the mast is a street pole or might have the feature that the mast is a street light pole. Typically the mast is used as a street pole and/or a street light pole (or street luminaire) comprising a lamp housing for accommodating a lamp or light source mounted at an end section of the elongated structure. An increasing number of street poles and street light poles in public spaces comprise concealed electronic apparatuses within the base section of their structure for ease of maintenance and servicing, like electric cabling, converters, drivers, a radio, battery back-ups, filters, and an antenna.

The invention further relates to a mast segment suitable for use in a mast of the invention, said mast segment at least having an internal bearing structure, the first mast segment comprises in the cavity as the internal bearing structure an axially extending inner cylinder connected via radially extending ribs to outer cylinder portions at a first end respectively a second end of the inner cylinder and said ribs axially extending from said first end to said second end, said inner structure being surrounded by an (optionally removably mounted) outer wall segment axially extending from said first end to said second end, the inner cylinder by a core wall of the inner cylinder encloses an axially extending core cavity acting as a cabling pass through by connecting the cavity in the base segment with the cavity in a second mast segment, both the first end and the second end of the inner cylinder have an extension shaft extending beyond the outer wall. Said mast segment can be considered as a modular part or antenna structure which can be mounted in single or in more numbers, for example if more antennas are desired, into an existing mast structure, rendering the mast to be a modular building structure or modular system.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

Figure 1:
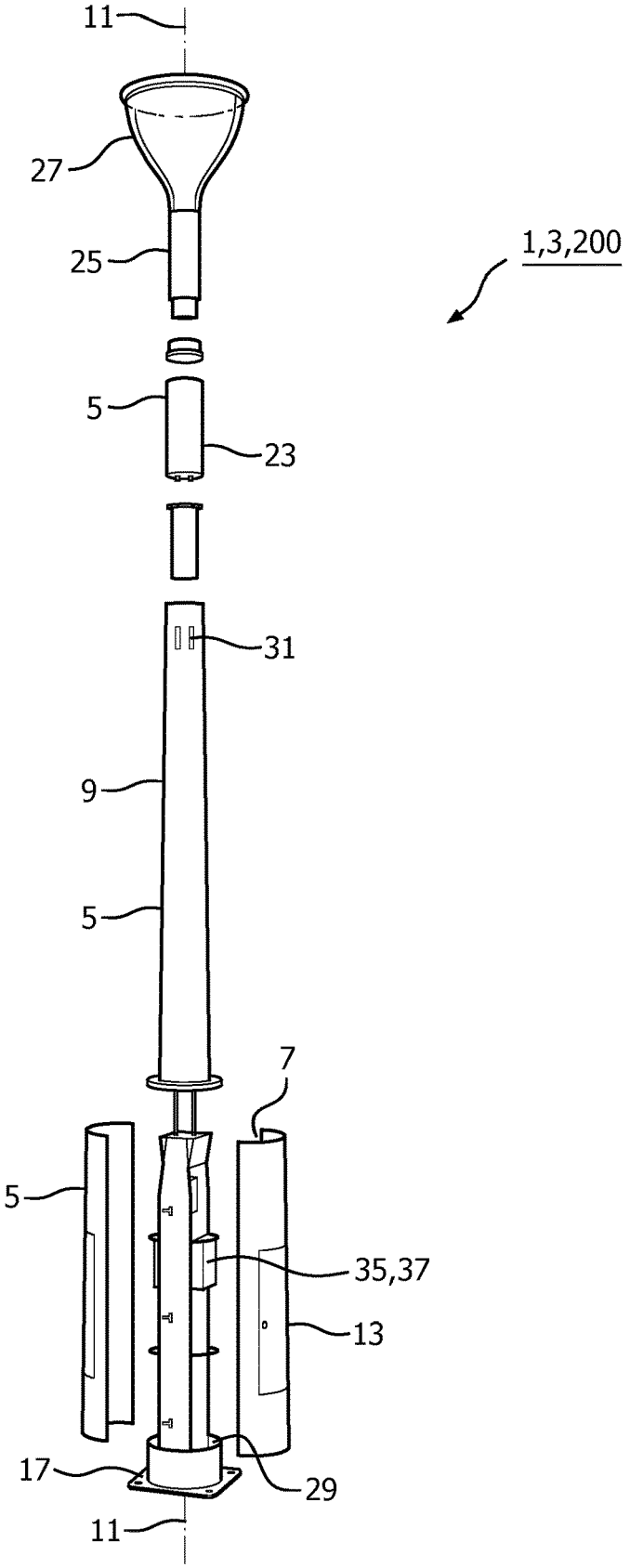
FIG. 1 shows a schematic overview of an elongated structure according to the invention embodied as a street light pole.

FIG. 1 schematically depicts a partly exploded elongated structure 1 comprising a mast 3 having at least a wall 5 around a hollow core 7 as a tubular body 9 extending along a length axis 11. A base mast segment 13 of the wall of the tubular body being connected to a first mast segment 23, which on its turn is further releasably connected to a second mast segment 25. The tubular body in the figure is a round cylindrical shape, but alternatively could be a hexagonally shaped cylinder or an irregular octagonally shaped cylinder, or axially extending, not completely circumferential, for example semi-circular, parts thereof. The elongated structure is embodied as a modular street light pole 200, and further mounted on the second mast segment a lamp housing 27. A first vent opening 29 is present at a foot 17 of the street light pole and a second vent opening 31 is provided in the base mast segment 13 just below the first mast segment. In the base mast segment electric equipment 35, for example a radio 37, is provided, for example to facilitate the functioning of an antenna provided in the first mast segment.

Figure 2A:
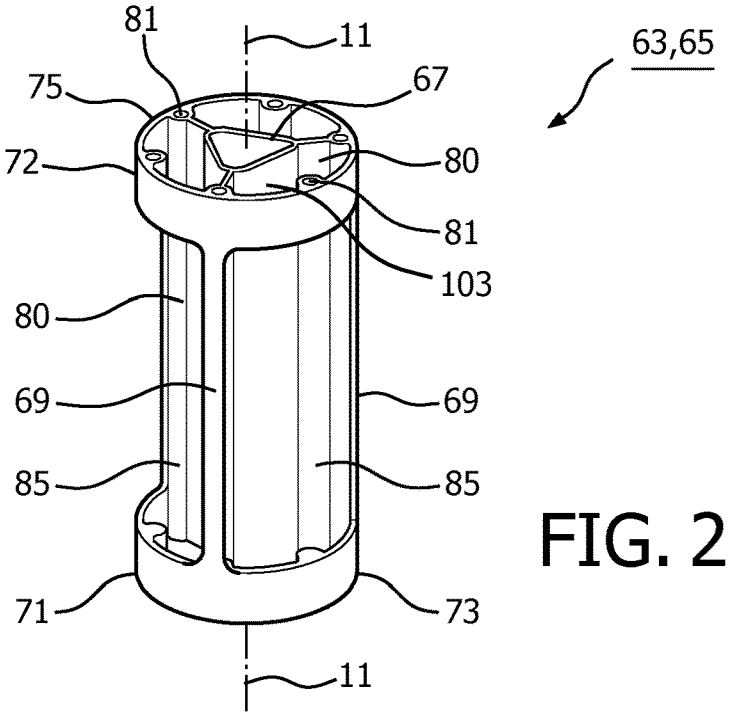
FIGS. 2*a-f* show detailed views of parts of the first mast segment of the street light pole of FIG. 1.

FIG. 2*a* shows a bearing frame part 63 of the internal bearing structure 65 of the first mast segment, said frame part is extruded in one integral part. The frame part has a triangularly shaped inner cylinder 67 having a core wall 103 from which three ribs 69 extend to outer cylinder parts 71,72 provided at respectively a first end 73 and a second end 75 of the frame part. Said ribs axially extend along longitudinal axis 11 from the first end to the second end thus creating compartments 80 for antenna elements. The outer cylinder parts 71,72 are provided with screw openings 81 for releasably mounting the frame part with bolts onto other mast parts. In the frame part cut-outs have been to act as antenna windows 85 for antenna elements to be provided in compartments (see FIG. 2*b*).

Figure 2B:
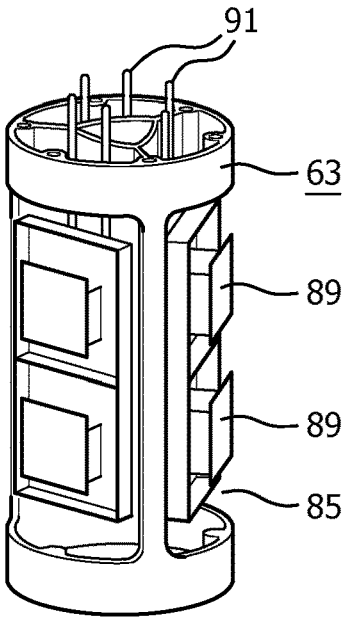
Figure 2C:
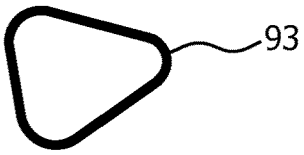
Figure 2D:
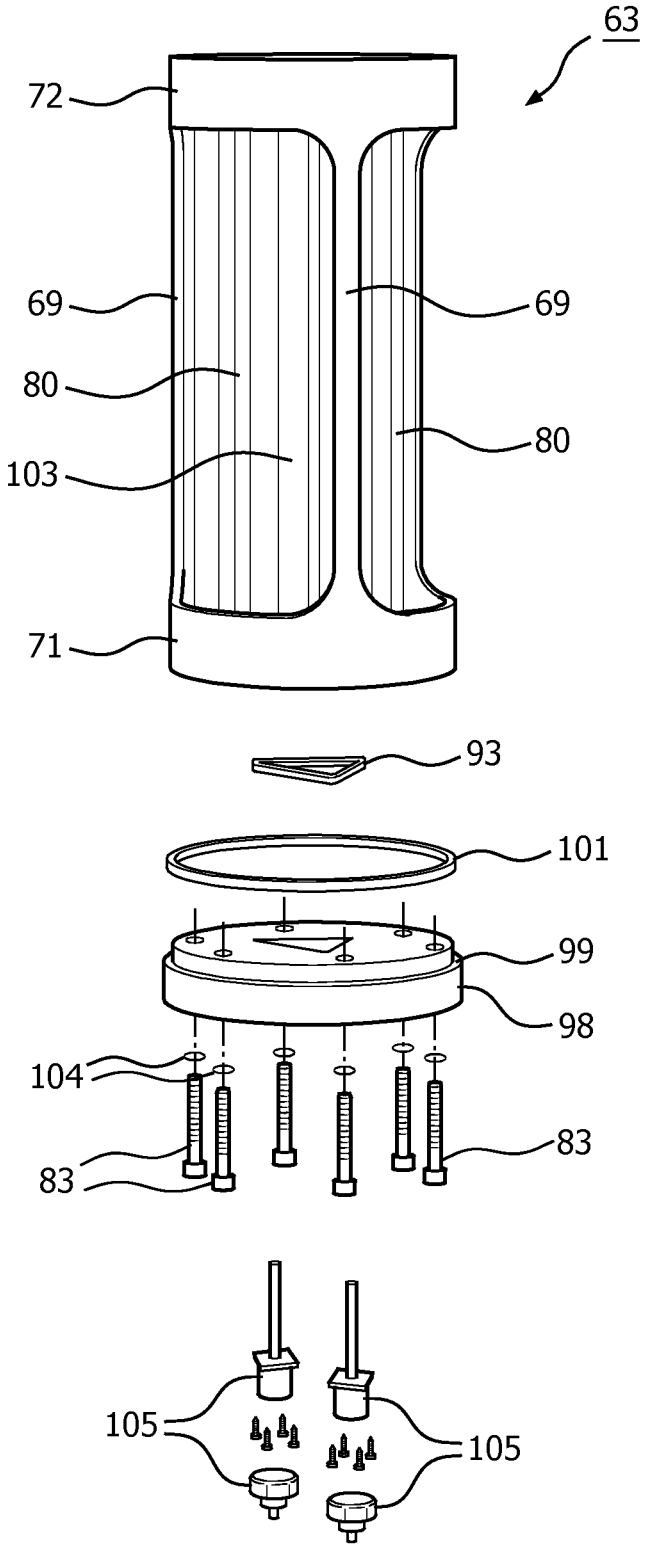
Figure 2E:
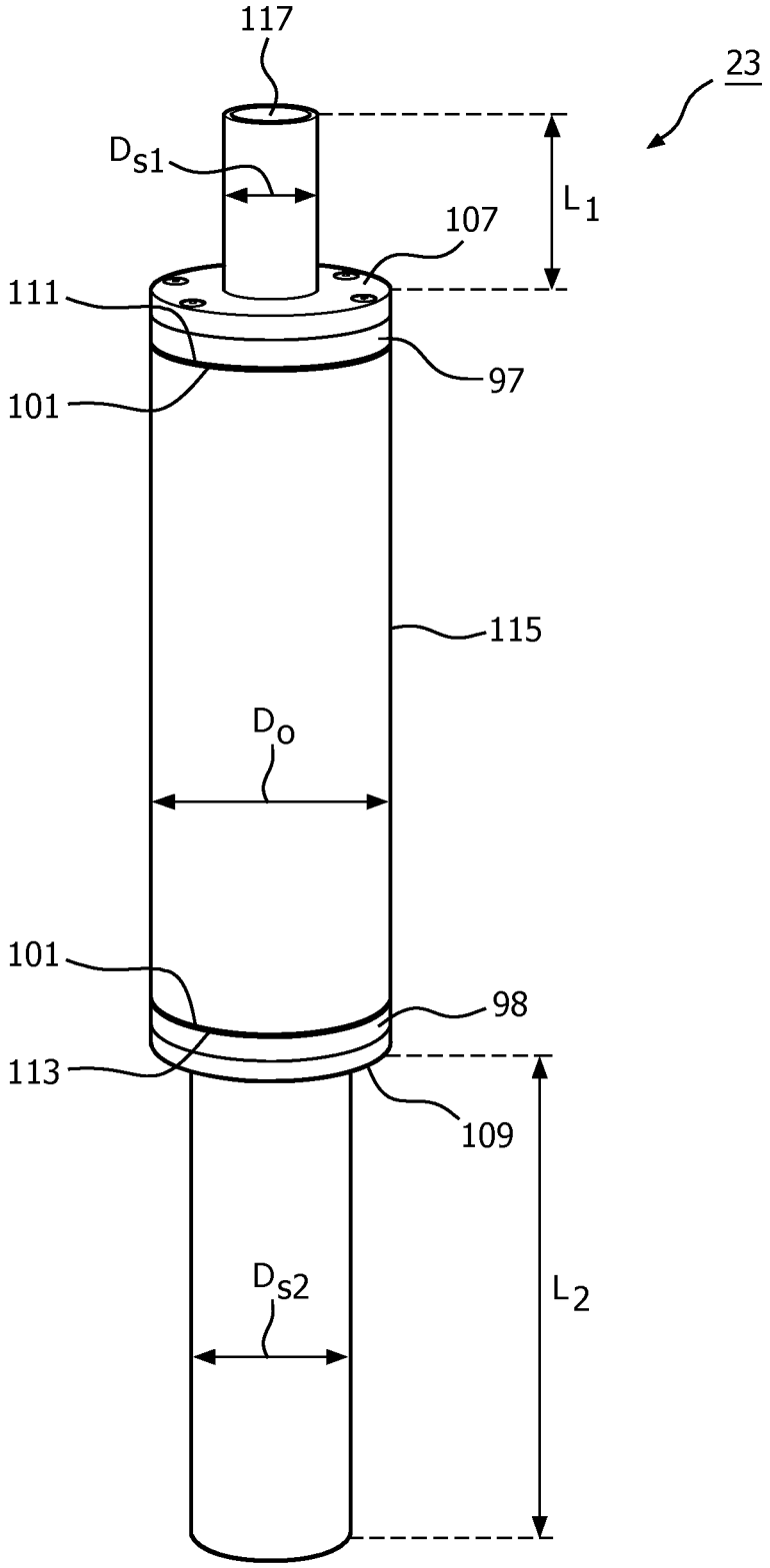

FIG. 2*b* shows the frame part 63 of FIG. 2*a* provided with antenna elements 89 and cabling 91, said antenna elements facing outwards to the RF windows 85, to be covered with a RF-transparent wall segment as shown in FIG. 2*e*.

FIG. 2*c* shows a triangular gasket 93 which can be used for sealing purposes of an internal (core) cavity, the shape of the gasket matches in size and cross-section shape of the inner triangular cylinder.

FIG. 2*d* shows an exploded view of the frame part 63 of FIG. 2*a* provided with an end cap 98. The end cap has a ridge 99 at which a gasket 101 of matching size and shape can be accommodated and which is pressed in assembled configuration against an end face of the outer wall segment (not shown in FIG. 2*d*, but see FIG. 2*e*) provided around the frame part, similarly a triangular gasket 93 is pressed between the end cap 98 and the core wall 103 of the frame part by threaded bolts 83 each provided with a bolt sealing ring 104. Thus sealing of compartments 80 formed by the ribs 69, the core wall 103, the outer wall segment and the outer cylinders 71, 72 can be obtained. Furthermore FIG. 2*d* shows sealed feedthroughs or connectors 105 for cabling, for example from a radio provided in the base mast segment to antennas to be accommodated in the compartments.

FIG. 2*e* shows the outer appearance of the completely assembled first mast segment 23 with on either side an end cap 97,98 provided with a respective extension shaft 107, 109. Said end cap is mounted on the ends of the inner and outer cylinders of the frame (not shown) and gaskets 101 are pressed between the end caps and the end faces 111,113 of the cylindrical outer wall segment 115. The length L1,L2 of each extension shaft is at least twice the diameter Ds1,Ds2 of the respective extension shaft. The diameters of the shaft are in the range of 0.3 to 0.7 times the diameter of the outer cylinder or outer wall segment Do. The extension shaft have a hollow core 117 rendering continuation of the cavity and enabling communication between the base mast segment, the first mast segment and the second mast segment.

Figure 2F:
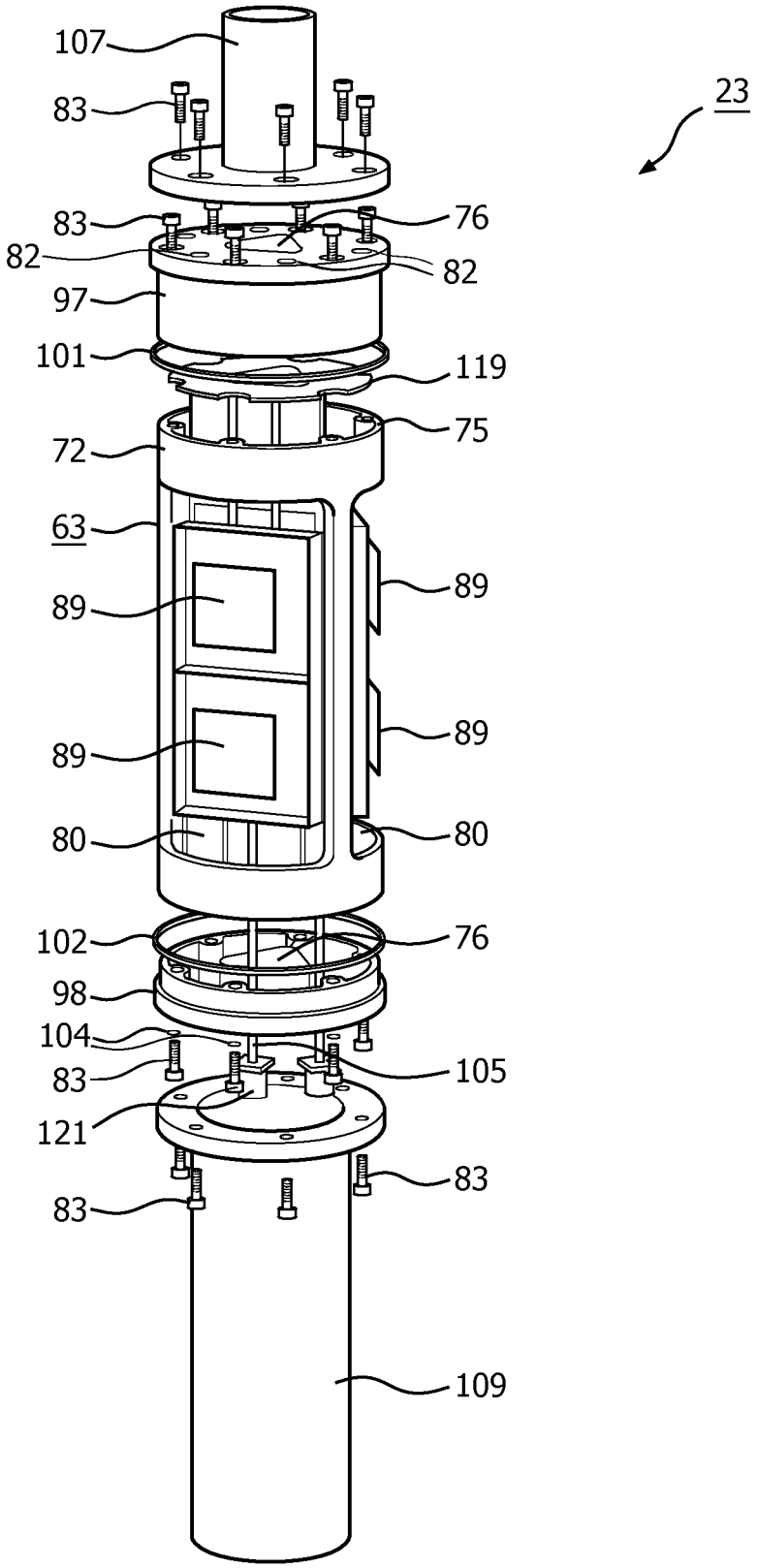

FIG. 2*f* shows the complete first mast segment 23 in exploded view, except for the outer wall segment and triangular gaskets. Top down is shown:

the upper extension shaft 107 for connection via bolts 83 of the first mast segment 23 to the second mast segment, the second end cap 97 thereof being provided with blind threaded holes 82 (enabling sealing);

the upper, second end cap 97 via bolts 83 each provided with bolt sealing ring 104, said second end cap to be mounted onto the outer cylinder 72 of the bearing frame 63;

a sealing gasket 101 to be pressed between the second end cap and the outer wall segment;

a specifically designed PCB 119 provided adjacent to the second end 75, said PCB being arranged around the core cavity 76, the PCB comprises a connection track pattern with a plurality of antenna connection points;

the bearing frame part 63 provided with antenna elements 89 in the compartments 80;

a sealing gasket 102 to be pressed between a lower, first end cap 98 and the outer wall segment;

the lower, first end cap 98;

cable connectors 121 for providing sealed feedthroughs of cabling 105 to antenna elements and PCB; and the lower extension shaft 109 for connection of the first mast segment to the base mast segment.

Figure 3:
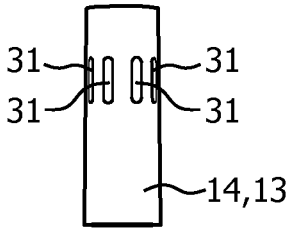
FIG. 3 shows a portion an extension section of the base mast segment of the street light pole of FIG. 1.

FIG. 3 shows a portion of a hollow, tubular extension portion 14 of the base mast segment 13 of the street light pole of FIG. 1 in more detail. The extension portion 14 has second vent openings 31 evenly distributed over the annular perimeter of the wall of the extension portion.

Figure 4:
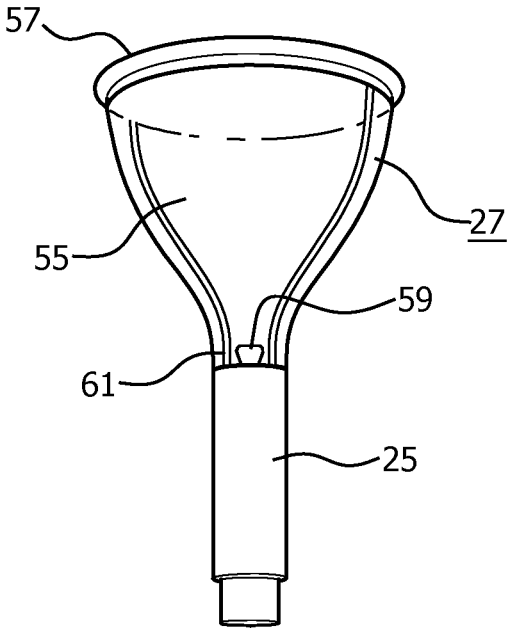
FIG. 4 shows a lamp housing of the street light pole of FIG. 1.

FIG. 4 shows a lamp housing 27 of the street light pole of FIG. 1 in more detail. The lamp housing is mounted on the second mast segment 25 of the elongated structure, and comprises a light transmissive light exit window 55 and a light reflective top cover 57 which during operation of the light source reflects light originating from the light source 59 mounted at the lamp base 61 of the housing and thus provides indirect light to the ambient.

Figure 5:
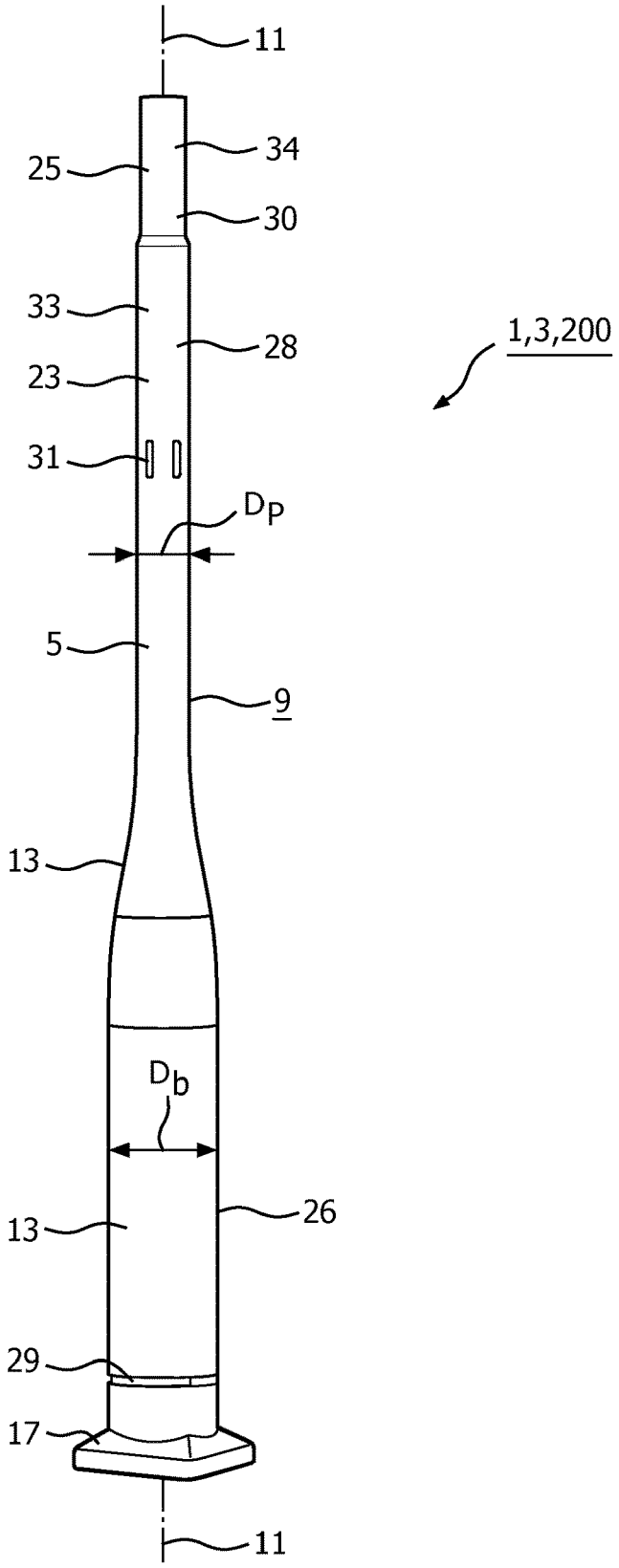
FIG. 5 shows a second embodiment of an elongated structure according to the invention.

FIG. 5 schematically shows an overview of an erected, elongated structure 1 according to a second embodiment of the invention. The elongated structure comprises a pole or mast 3 having at least a wall 5 around a hollow core as a tubular body 9 extending along a length axis 11. A base mast segment 13 of the wall of the tubular body being connected to a foot 17 of the mast and to a first mast segment 23 along the length axis. As shown, in the elongated structure a maximum diameter Db from the base mast segment continuously decreases in axial direction to the diameter Dp of the first mast segment 23 and an outer surface 26 of the wall of the base mast segment is flush with an outer surface 28 of an adjacent wall of the first mast segment of the tubular body. The outer surface of first mast segment on its turn is flush with the outer surface 30 of a second mast segment 25. As shown, the diameter of the elongated structure smoothly, gradually decreases from the base section to the top section. The elongated structure is embodied as a modular street pole 200, and further comprises the first mast segment 23 and the second mast segment 25 in which respectively an antenna 33 and a GPS module 34 are provided. A first vent opening 29 is present in the base mast section near the foot of the street pole and a second vent opening 31 is provided in the base mast segment just below the first mast segment.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to". The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A mast having a longitudinal axis and comprising:

a modular, hollow tubular body having a circumferential outer wall with an outer surface and enclosing an axially extending cavity, said tubular body comprising in its cavity a first mast segment arranged in between a base segment and a second mast segment and releasably connected thereto, each of the base, first and second mast segment has a bearing structure for bearing the weight of the mast, at least the first mast segment comprises an internal bearing structure in the cavity an axially extending inner cylinder connected via radially extending ribs to a first outer cylinder portion provided at a first end of the inner cylinder and a second outer cylinder portion provided at a second end of the inner cylinder and said ribs axially extending from said first end to said second end, wherein each of the ribs axially extend to connect the first outer cylinder portion to the second outer cylinder portion, said internal structure being surrounded by an outer wall segment axially extending from said first end to said second end, the inner cylinder by a core wall of the inner cylinder encloses an axially extending core cavity for enabling cabling to pass through from the cavity in the base segment to the cavity in the second mast segment, both the first end and the second end of the inner cylinder have an extension shaft, in mounted position the first mast segment is connected with a first end of its core wall directly to the base part and with a second end of its core wall to the second mast segment, wherein the inner cylinder, the first outer cylinder portion, the second outer cylinder portion, at least two of the ribs and the outer wall segment of the first mast segment enclose at least one axially extending compartment, wherein the first mast segment has at the first end and the second end respectively a first and second closing feature each comprising as a sealing portion of a first gasket and a second gasket, which, in mounted position, are pressed between respectively the outer wall segment and a respective extension shaft and the core wall and a respective extension shaft to seal said compartment, and wherein the extension shaft of both the first end and the second end of the inner cylinder extend beyond the outer wall, in mounted position a respective extension shaft being inserted into an associated cavity of the base segment and of the second mast segment.

2. The mast as claimed in claim 1, wherein said extension shaft has a length that is at least two times a maximal diameter of said first mast segment.

3. The mast as claimed in claim 1, wherein the base segment, the first mast segment and the second mast segment have mutually matching shapes and diameters in cross-section.

4. The mast as claimed in claim 3, wherein in mounted position the outer surface of the outer wall of the base segment, the first mast segment and the second mast segment are flush.

5. The mast as claimed in claim 1, wherein at least one of the inner cylinder and outer cylinder comprises an end cap having a feature matching to a shape of the first gasket and the second gasket as a sealing portion.

6. The mast as claimed in claim 1, wherein the internal structure of the first mast segment is an integral, extruded part.

7. The mast as claimed in claim 1, wherein the first mast segment comprises a plurality of compartments defined by the internal bearing structure and separated by the ribs.

8. The mast as claimed in claim 1, wherein the compartment accommodates both an electronic component and an associated antenna element facing towards the outer wall segment, said outer wall segment being at least partly made of RF transparent material.

9. The mast as claimed in claim 1, wherein each compartment comprises a respective antenna element and an antenna window coupled to the antenna element, and wherein at least a portion of the cabling passes through each compartment.

10. The mast as claimed in claim 1, wherein the mast is a street pole.

11. The mast as claimed in claim 1, wherein the mast is a street pole light.

12. The mast as claimed in claim 1, wherein the first mast segment comprises a first end cap coupled to the first outer cylinder and the first end of the inner cylinder and a second end cap coupled to the second outer cylinder and the second end of the inner cylinder.

13. The mast as claimed in claim 12, comprising:

the first gasket positioned between the first end cap and the first end of the inner cylinder to seal the inner cylinder; and the second gasket positioned between a ridge surface of the first end cap and an end face of the first outer cylinder to seal at least one end of each compartment.

14. The mast as claimed in claim 13, comprising:

the first gasket positioned between the second end cap and the second end of the inner cylinder to seal the inner cylinder; and the second gasket positioned between a ridge surface of the second end cap and an end face of the second outer cylinder to seal at least one end of each compartment.

* * * * *